US008995680B2

(12) United States Patent
Yin

(10) Patent No.: US 8,995,680 B2
(45) Date of Patent: Mar. 31, 2015

(54) POWER-SAVING MONITORING CIRCUIT APPLIED TO AN ELECTROSTATIC EARPHONE HAVING A THIN FILM AND A PLURALITY OF ELECTRODE PLATES

(75) Inventor: Pen-Chiang Yin, Taoyuan County (TW)

(73) Assignee: Fortune Grand Technology Inc., Taoyuan County (TW)

( * ) Notice: Subject to any disclaimer, the term of this patent is extended or adjusted under 35 U.S.C. 154(b) by 314 days.

(21) Appl. No.: 13/611,560

(22) Filed: Sep. 12, 2012

(65) Prior Publication Data

US 2014/0072139 A1 Mar. 13, 2014

(51) Int. Cl.

*H04R 1/10* (2006.01)
*H04R 3/00* (2006.01)
*H04R 19/02* (2006.01)

(52) U.S. Cl.

CPC ..... *H04R 3/00* (2013.01); *H04R 1/1091* (2013.01); *H04R 19/02* (2013.01); *H04R 2460/03* (2013.01)

USPC ..... 381/74

(58) Field of Classification Search

None

See application file for complete search history.

(56) References Cited

U.S. PATENT DOCUMENTS 3,992,585 A * 11/1976 Turner et al. ..... 381/110
4,809,339 A * 2/1989 Shih et al. ..... 381/110

* cited by examiner

*Primary Examiner* — Daniell L Negron
(74) *Attorney, Agent, or Firm* — WPAT, P.C.; Anthony King

(57) ABSTRACT

A power-saving monitoring circuit is applied in an electrostatic earphone having a thin film and a plurality of electrode plates. In the power-saving monitoring circuit, an input unit receives an audio frequency signal; an output unit outputs the audio frequency signal to the electrode plates through; a detection unit detects the audio frequency signal and generates a control signal corresponding to the audio frequency signal to control a switch unit coupled to a power supply unit; a switch unit supplies a first voltage generated by the power supply unit to the driving module; a driving module converts the first voltage into a second voltage to drive the thin film. Since the switch unit cannot supply the first voltage to the driving module through, the driving module needs not to convert the first voltage. The electrostatic earphone is driven by the audio frequency signal automatically to achieve the power-saving effect.

8 Claims, 7 Drawing Sheets

POWER-SAVING MONITORING CIRCUIT APPLIED TO AN ELECTROSTATIC EARPHONE HAVING A THIN FILM AND A PLURALITY OF ELECTRODE PLATES

FIELD OF THE INVENTION

The present invention relates to a power-saving monitoring circuit, in particular to the power-saving monitoring circuit applied in an electrostatic earphone that is driven by a high voltage.

BACKGROUND OF THE INVENTION

In general, an electrostatic earphone has excellent frequency response and provides a very broad range of playing an audio frequency signal.

However, the operation of the electrostatic earphone is driven by boosting a low voltage (such as several volts) to a high voltage (such as several hundreds of volts). In general, a conventional electrostatic earphone uses utility power as the low-voltage power source. If the power source is changed to a primary battery or a secondary battery, then the efficiency of converting the low voltage to the high voltage will be affected significantly, or the primary or secondary battery may be even damaged during the conversion which will affect the service life of the battery adversely.

In addition, the power source of the conventional electrostatic earphone is maintained at a power supplying state, no matter whether the electrostatic earphone has received an input of the audio frequency signal. Therefore, the power supply method intangibly causes a waste of energy and the using time of the primary or secondary battery. Obviously, the conventional electrostatic earphone requires an improved circuit to overcome the aforementioned problem.

SUMMARY OF THE INVENTION

It is a primary objective of the present invention to provide a power-saving monitoring circuit, wherein a switch unit is trigger by an audio frequency signal automatically, so that a driving module converts a first voltage into a second voltage (which is a high voltage) to drive an electrostatic earphone, so as to achieve the power saving effect.

Another objective of the present invention is based on the aforementioned power-saving monitoring circuit, wherein the magnitude of a reference voltage is selected to determine the voltage sensitivity of the audio frequency signal used for triggering a control signal of the switch unit.

A further objective of the present invention is based on the aforementioned power-saving monitoring circuit, wherein a latch circuit is provided for maintaining, setting or resetting the control signal for triggering the control unit.

Another objective of the present invention is based on the aforementioned power-saving monitoring circuit, wherein a delay circuit is provided for compensating the electric power switching loss caused by a quick switch executed by the driving module, since a portion of the continuous audio frequency signals lower than the voltage sensitivity cannot be detected.

Another objective of the present invention is based on the aforementioned power-saving monitoring circuit, wherein a trigger unit is provided for triggering the control unit directly, so that the driving module can drive the electrostatic earphone no matter whether the audio frequency signal is detected.

To achieve the aforementioned and other objectives, the present invention provides a power-saving monitoring circuit applied to an electrostatic earphone having a thin film and a plurality of electrode plates. The power-saving monitoring circuit comprises a power supply unit, an input unit, a detection unit, a switch unit, a driving module and an output unit. Wherein, the power supply unit is provided for generating a first voltage; the input unit is provided for receiving an audio frequency signal; the detection unit is coupled to the input unit for detecting the audio frequency signal received by the input unit and selectively generating a control signal corresponding to the audio frequency signal according to the voltage amplitude of the audio frequency signal; the switch unit has a control terminal, an input terminal and an output terminal. Wherein, the switch unit is coupled to the power supply unit through the input terminal, and the switch unit receives a control signal through the control terminal, and the switch unit controls a conducting state between the input terminal and the output terminal according to the control signal for selectively transmitting the first voltage from the input terminal to the output terminal; the driving module is coupled to the switch unit for selectively converting the first voltage into a second voltage according to the conducting state to drive the thin film; and the output unit is coupled to the input unit for outputting the audio frequency signal to the electrode plates.

Compared with the prior art, the power-saving monitoring circuit of the present invention detects whether an audio frequency signal is inputted, in order to automatically generate a second voltage (which is a high voltage) required for driving an electrostatic earphone and reduce power consumption to achieve the power saving effect. Since the voltage of the audio frequency signal is still too low among the continuous audio frequency signals and cannot be detected, a delay circuit provides a time constant for extending the trigger time required for stopping the output of the second voltage. In addition, the present invention also provides a trigger control which is not affected by the audio frequency signal, so that the second voltage can drive the electrostatic earphone directly with or without having the audio frequency signal.

DETAILED DESCRIPTION OF THE PREFERRED EMBODIMENTS

The objects, characteristics and effects of the present invention will become apparent with the detailed description of the preferred embodiments and the illustration of related drawings as follows.

Figure 1:
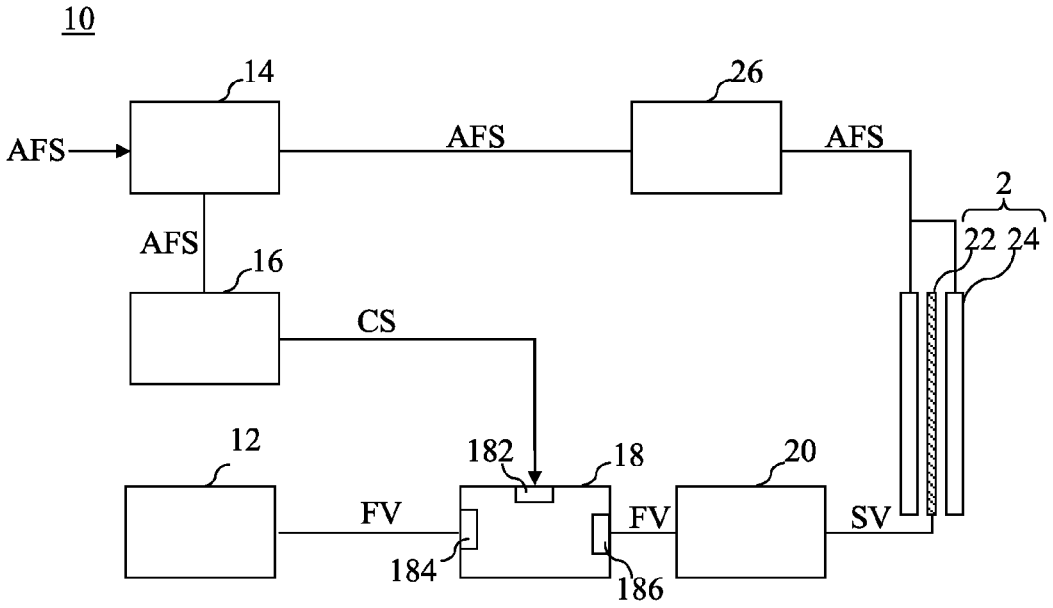
FIG. 1 is a schematic block diagram of a power-saving monitoring circuit in accordance with a first preferred embodiment of the present invention.

With reference to FIG. 1 for a schematic block diagram of a power-saving monitoring circuit in accordance with the first preferred embodiment of the present invention, the power-saving monitoring circuit 10 is applied to an electrostatic earphone 2. Wherein, the electrostatic earphone 2 comprises a thin film 22 and a plurality of electrode plates 24, and the thin film 22 is disposed between the electrode plates 24. In the electrostatic earphone 2, the thin film 22 is driven by a high voltage (approximately equal to 500 volts), and an audio frequency signal AFS is transmitted to the electrode plates 24 for producing sound to the electrostatic earphone 2. Wherein, the audio frequency signal AFS is defined as a signal of a sound wave with a frequency falling within a range from 5 Hz to 50 KHz.

Wherein, the power-saving monitoring circuit 10 comprises a power supply unit 12, an input unit 14, a detection unit 16, a switch unit 18, a driving module 20 and an output unit 26.

The power supply unit 12 is provided for generating a first voltage FV. For example, the power supply unit 12 can be utility power converted into DC, a primary battery, a secondary battery, or any combination of the above. For example, the power supply unit 12 is a lithium-ion battery (Li-ion), and the lithium-ion battery can be resupplied by converting utility power into DC. In addition, the lithium-ion battery supplies the first voltage FV equal to 3.7 volts.

The input unit 14 receives the audio frequency signal AFS which is outputted to the electrode plates 24 directly through the output unit 26.

The detection unit 16 is coupled to the input unit 14 for detecting the audio frequency signal AFS of the input unit 14. If the input unit 14 has received an inputted audio frequency signal AFS, the input unit 14 will have a change of voltage amplitude, and the detection unit 16 will generate a control signal CS corresponding to the audio frequency signal AFS according to the voltage amplitude of the audio frequency signal AFS.

The switch unit 18 has a control terminal 182, an input terminal 184 and an output terminal 186. For example, the switch unit 18 can be a three-terminal component such as a transistor (BJT) or a metal oxide semiconductor field effect transistor (MOSFET). For example, the switch unit 18 of this embodiment is the metal oxide semiconductor field effect transistor, wherein the control terminal 182 is corresponsive to a gate, and the input terminal 184 is corresponsive to a source, and the output terminal 186 is corresponsive to a drain.

In addition, the switch unit 18 is coupled to the power supply unit 12 through the input terminal 184 to receive the first voltage FV, and the switch unit 18 receives the control signal CS through the control terminal 182. In addition, the switch unit 18 controls a conducting state between the input terminal and the output terminal according to the control signal CS for transmitting the first voltage FV from the input terminal to the output terminal 186. Wherein, the conducting state is defined as a connection or a disconnection between the input terminal 184 and the output terminal 186.

The driving module 20 is coupled to the switch unit 18, and the driving module 20 selectively converts the first voltage FV into a second voltage to drive the thin film 22 according to the conducting state. Wherein, the second voltage has a voltage value greater than the voltage value of the first voltage. In another preferred embodiment, the driving module 20 comprises a rectifier unit and a transformer unit (not shown in the figure), wherein the rectifier unit and the transformer unit convert the first voltage into the second voltage.

Therefore, the power-saving monitoring circuit 10 can selectively generate the control signal CS according to the situation whether or not the audio frequency signal AFS is detected by the detection unit 16, and the control signal can trigger the switch unit 18 whether or not to supply the first voltage FV to the driving module 20 to convert to the second voltage SV (which is a high voltage) required for driving the electrostatic earphone 2. In other words, if the audio frequency signal AFS has not been inputted or cannot be detected by the detection unit 16, then the first voltage FV cannot be supplied to the driving module 20, so that the driving module 20 will not have the power consumption issue.

Figure 2:
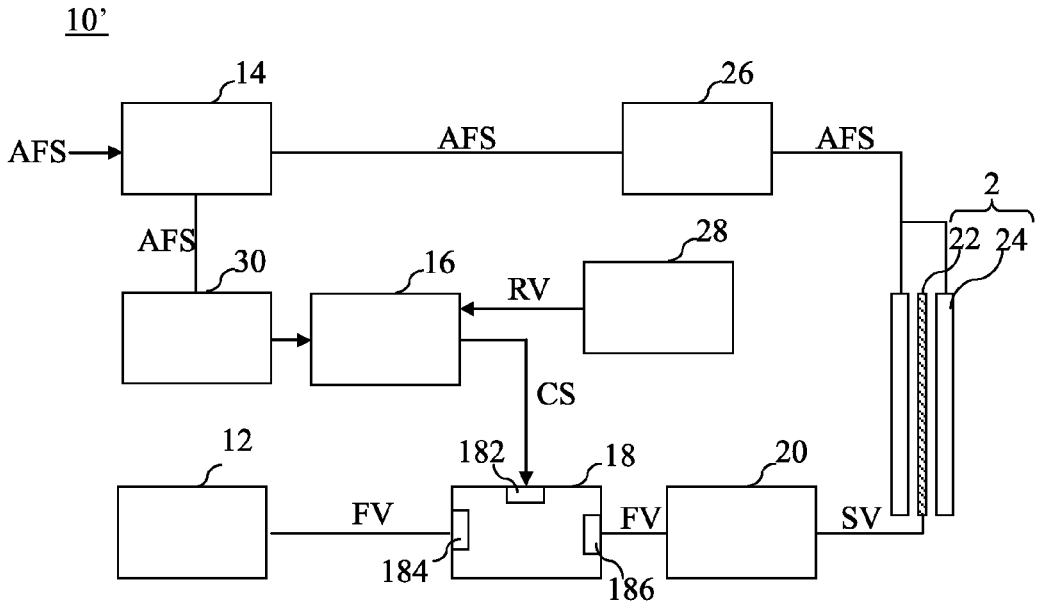
FIG. 2 is a schematic block diagram of a power-saving monitoring circuit in accordance with a second preferred embodiment of the present invention.

With reference to FIG. 2 for a schematic block diagram of a power-saving monitoring circuit in accordance with the second preferred embodiment of the present invention, the power-saving monitoring circuit 10' further comprises a reference unit 28 and a pre-amplification unit 30 in addition to the power supply unit 12, the input unit 14, the detection unit 16, the switch unit 18, the driving module 20 and the output unit 26 as described in the first preferred embodiment.

Wherein, the reference unit 28 is coupled to the detection unit 16. The reference unit 28 generates a reference voltage RV, and the detection unit 16 can use the reference voltage as a determination basis to determine whether or not the voltage amplitude is sufficient to generate the control signal CS corresponding to the audio frequency signal AFS. In other words, the reference voltage RV can be adjusted to determine the voltage sensitivity detected by the detection unit 16 and use it as the basis for determining whether the audio frequency signal AFS can be detected.

The pre-amplification unit 30 is coupled to the input unit 14 and the detection unit 16. Wherein, the pre-amplification unit 30 is provided for amplifying the voltage amplitude of the audio frequency signal AFS and outputting the voltage amplitude to the detection unit 16. The pre-amplification unit 30 amplifies the voltage amplitude of the audio frequency signal AFS in compliance with the electric properties of the detection unit 16.

Figure 3:
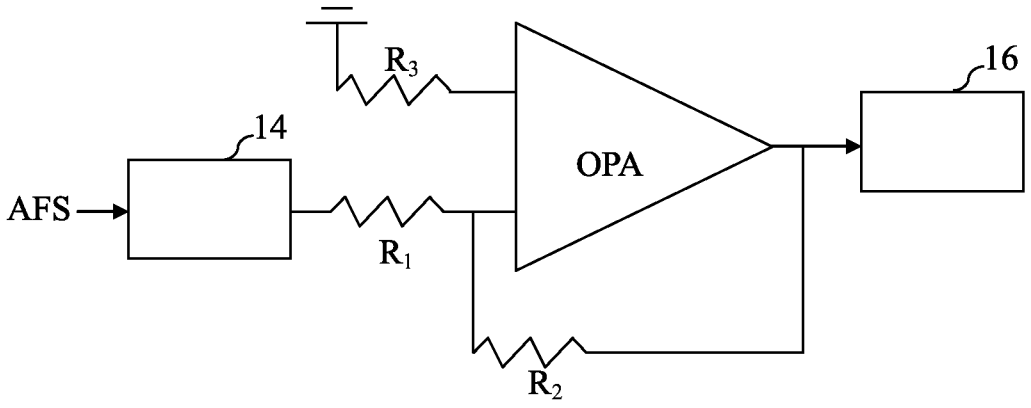
FIG. 3 is a schematic view of the connection of a pre-amplification unit, an input unit and a detection unit as depicted in FIG. 1.

With reference to FIG. 3 for a schematic view of the connection of the pre-amplification unit 30, the input unit 14 and the detection unit 16 in details, the pre-amplification unit 30 is comprised of an operational amplifier OPA and a plurality of resistors R1, R2, R3, and the times of voltage amplification of the pre-amplification unit 30 is determined by the resistance ratio of R1 to R2.

Figure 4:
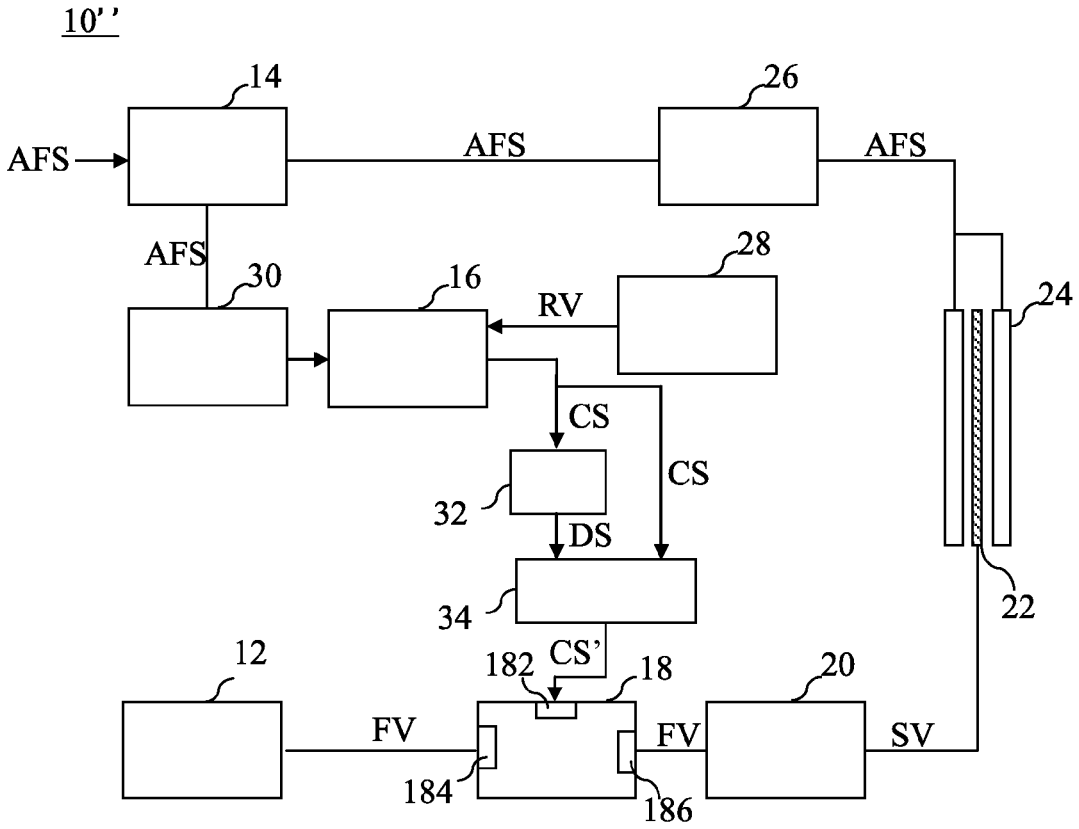
FIG. 4 is a schematic block diagram of a power-saving monitoring circuit in accordance with a third preferred embodiment of the present invention.

With reference to FIG. 4 for a schematic block diagram of a power-saving monitoring circuit in accordance with the third preferred embodiment of the present invention, the power-saving monitoring circuit 10" further comprises a delay unit 32 and a latch unit 34 in addition to the power supply unit 12, the input unit 14, the detection unit 16, the switch unit 18, the driving module 20 and the output unit 26 as described in the first preferred embodiment.

The delay unit 32 is coupled to the detection unit 16, and the delay unit 32 delays a time constant t of the control signal CS to form a delay signal DS. For example, the delay unit 32 is comprised of a resistor and at least one selected from a capacitor or an inductor. In other words, the delay unit 32 must charge the capacitor or the inductor before the control signal CS reaches the switch unit 18 or the latch unit 34, and the original voltage level of the control signal CS can be resumed till the time constant t is reached. For example, the delay unit 32 of this emboidment is comprised of a resistor R and a capacitor C, and the time constant t is calculated by the following mathematical equation:

$t=RC$

The latch unit 34 is coupled to the detection unit 16, the delay unit 32 and the switch unit 18. After the latch unit 34 receives the control signal CS and the delay signal DS, the latch unit 34 generates other control signal CS' for controlling the switch unit 18. In addition, a voltage level of the other control signal CS' is maintained, set, or reset by the latch unit 34 according to the control signal CS.

Figure 5:
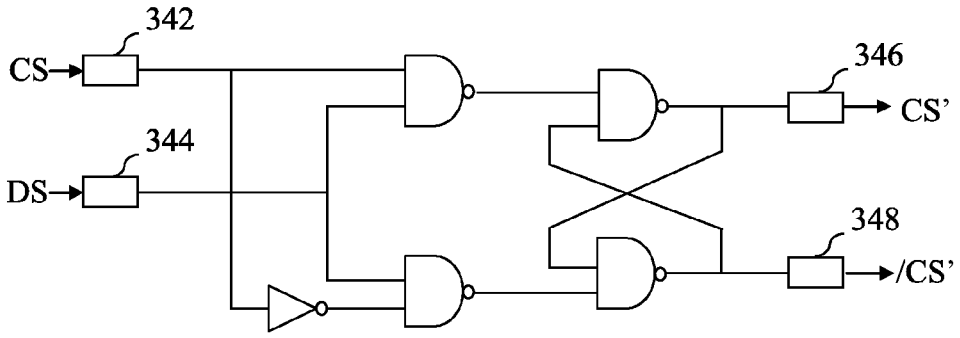
FIG. 5 is a schematic view of the circuit of a latch unit as depicted in FIG. 4.

With reference to FIG. 5 for the circuit connection of the latch unit 34 in accordance with the third preferred embodiment of the present invention, the latch unit 34 is a D-latch in this embodiment, and it is noteworthy that the latch unit 34 can also be of another type such as a RS latch or a JK latch.

In FIG. 5, the D-latch has a first input terminal 342 (for receiving the control signal CS), a second input terminal 344 (for receiving the delay signal DS), a first output terminal 346 and a second output terminal 348, In additon, the first output terminal 346 and the second output terminal 348 ouput opposite logic potentials respectively, and the switch unit 18 selects a voltage level outputted from the first output terminal 346 or the second output terminal 348 as the control signal CS'. Wherein, the D-latch is comprised of four NAND gates and one NOT gate, and Table 1 shows a truth table of the D-latch.

TABLE 1

| First input terminal | Second input terminal | First output terminal | Second output terminal | Action |
|---|---|---|---|---|
| 0 | 0 | Maintain | Maintain | Maintain |
| 1 | 0 | 0 | 1 | Control and turn on the switch unit, so that a conducting state between the power supply unit and the driving module occurs to let the driving module obtain the first voltage. |
| 0 | 1 | 1 | 0 | Control and turn off the switch unit, so that a disconnection state between the power supply unit and the driving module occurs to stop the driving module from obtaining the first voltage. |
| 1 | 1 | Maintain | Maintain | Maintain |

From the truth table, if the voltage of the second input terminal 344 is at the state if logic 0 (representing a voltage equal to 0 volt), then the logic state of the first output terminal 346 is maintained at the original voltage level which is logic 0 or logic 1 (such as a voltage equal to 5 volts) regardless of the input condition of the first input terminal 342; and if the voltage level of the second input terminal 344 is at the state of logic 1, then the first output terminal 346 is set to the state of logic 1, or the voltage level of the first output terminal 346 is reset to logic 0 according to the voltage level of the first output terminal 346.

In the truth table, the control terminal 182 of the switch unit 18 can be triggered to change or maintain the conducting state between the input terminal 184 and the output terminal 186.

Figure 6:
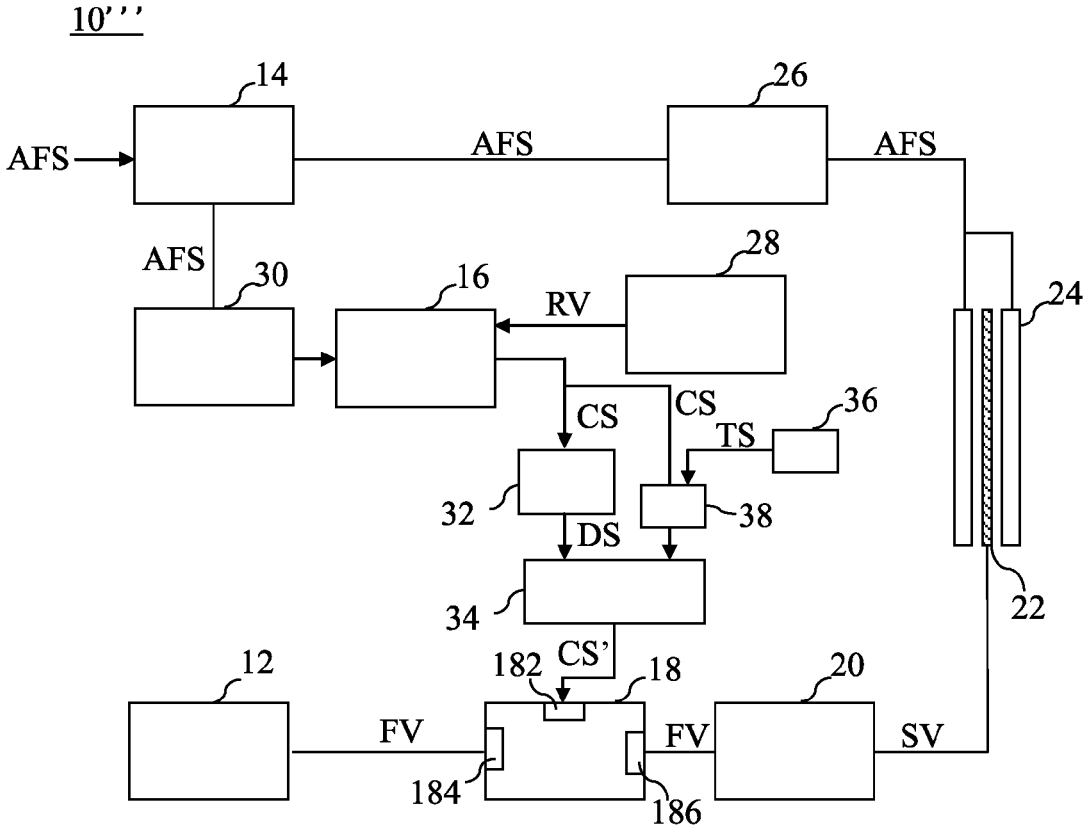
FIG. 6 is a schematic block diagram of a power-saving monitoring circuit in accordance with a fourth preferred embodiment of the present invention.

With reference to FIG. 6 for a schematic block diagram of a power-saving monitoring circuit in accordance with the fourth preferred embodiment of the present invention, the power-saving monitoring circuit 10''' further comprises a trigger unit 36 and a logic gate unit 38 in addition to the power supply unit 12, the input unit 14, the detection unit 16, the switch unit 18, the driving module 20, the output unit 26, the delay unit 32 and the latch unit 34 as described in the third preferred embodiment.

The trigger unit 36 generates a trigger signal TS. For example, the trigger unit 36 is a press key.

Figure 7:
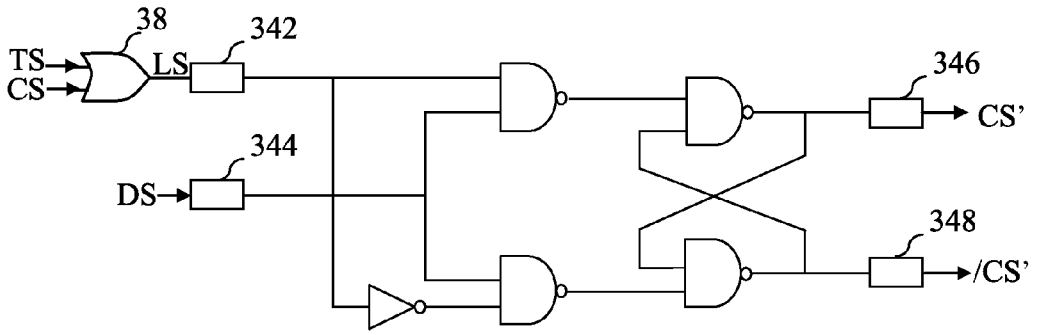
FIG. 7 is a schematic view of the circuit of a latch unit as depicted in FIG. 6.

The logic gate unit 38 is coupled to the trigger unit 36 and the detection unit 16, and after the logic gate unit 38 receives the trigger signal TS and the control signal CS, a logic signal LS is generated and transmitted to the latch unit 34. In FIG. 7, the logic gate unit 38 of this embodiment is an OR gate. When the D-latch is used, the truth table of the D-latch is as shown in Table 2. Wherein, the logic signal LS of the first input terminal 342 is generated by the trigger signal TS and the control signal CS through the OR gate.

TABLE 2

| CS | TS | First input terminal (LS) | Second input terminal | First output terminal | Second output terminal | Action |
|---|---|---|---|---|---|---|
| 0 | 0 | 0 | 0 | 0 | 1 | Maintain |
| 0 | 1 | 1 | 0 | 1 | 0 | Determined by TS to turn on the switch unit |
| 1 | 0 | 1 | 0 | 1 | 0 | Determined by CS to turn on the switch unit |
| 1 | 1 | 1 | 0 | 1 | 0 | Jointly determined by TS, CS to turn on the switch unit |

The power-saving monitoring circuit of the present invention detects whether an audio frequency signal is inputted to automatically generate a second voltage which is a high voltage required for driving the electrostatic earphone, so as to reduce the power consumption and achieve the power saving effect. In addition, the voltage of the audio frequency signal is still too low among the continuous audio frequency signals and cannot be detected, so that the delay circuit can provide a time constant for extending the trigger time required for stopping the output of the second voltage. In addition, the present invention also provides a trigger control that will not be affected by the audio frequency signal, and the second voltage can drive the electrostatic earphone directly with or without having the audio frequency signal.

While the invention has been described by means of specific embodiments, numerous modifications and variations could be made thereto by those skilled in the art without departing from the scope and spirit of the invention set forth in the claims.

What is claimed is:

1. A power-saving monitoring circuit, applied to an electrostatic earphone having a thin film and a plurality of electrode plates, comprising:

a power supply unit, for generating a first voltage;

an input unit, for receiving an audio frequency signal;

a detection unit, coupled to the input unit, for detecting the audio frequency signal received by the input unit, and selectively generating a control signal corresponding to the audio frequency signal according to a voltage amplitude of the audio frequency signal;

a switch unit, having a control terminal, an input terminal and an output terminal, and coupled to the power supply unit through the input terminal, for receiving a control signal through the control terminal, and controlling a conducting state between the input terminal and the output terminal according to the control signal to transmit the first voltage selectively from the input terminal to the output terminal;

a driving module, coupled to the switch unit, for selectively converting the first voltage into a second voltage according to the conducting state to driving the thin film, wherein the second voltage has a voltage value greater than the voltage value of the first voltage;

an output unit, coupled to the input unit, for outputting the audio frequency signal to the electrode plates; and a latch unit, coupled to the detection unit and the switch unit, and generating other control signal for controlling the switch unit after the latch unit receives the control signal, wherein a voltage level of the other control signal is maintained, set, or reset by the latch unit according to the control signal.

2. The power-saving monitoring circuit of claim 1, further comprising a reference unit coupled to the detection unit for generating a reference voltage provided for the detection unit to determine the voltage amplitude based on the reference voltage to generate a control signal corresponding to the audio frequency signal.

3. The power-saving monitoring circuit of claim 2, further comprising a pre-amplification unit coupled to the input unit and the detection unit and provided for amplifying the voltage amplitude of the audio frequency signal and outputting voltage amplitude to the detection unit.

4. The power-saving monitoring circuit of claim 1, further comprising a delay unit coupled to the detection unit for delay a time constant of the control signal to form a delay signal.

5. The power-saving monitoring circuit of claim 4, wherein the delay unit is comprised of a resistor and at least one selected from a capacitor and an inductor.

6. The power-saving monitoring circuit of claim 4, wherein the latch unit is further coupled to the delay unit, and generates said other control signal after the latch unit further receives the delay signal.

7. A The power-saving monitoring circuit of claim 1, further comprising a trigger unit and a logic gate unit, and the trigger unit generates a trigger signal, and the logic gate unit is coupled to the trigger unit and the detection unit, and a logic signal is generated and transmitted to the latch unit after the logic gate unit receives the trigger signal and the control signal.

8. The power-saving monitoring circuit of claim 1, wherein the driving module includes a rectifier unit and a transformer unit, and the rectifier unit and the transformer unit convert the first voltage into the second voltage.

* * * * *